US005307973A

United States Patent [19]

Schmidt et al.

[11] Patent Number: 5,307,973

[45] Date of Patent: May 3, 1994

[54] PROFILED ROD FOR A WEB-SPREADING ROLLER

[75] Inventors: Heinrich Schmidt, Stadtbergen; Otto Lorenz, Neusass; Werner Geyer, Augsburg, all of Fed. Rep. of Germany

[73] Assignee: Erhardt & Leimer GmbH, Augsburg, Fed. Rep. of Germany

[21] Appl. No.: 635,186

[22] PCT Filed: Apr. 27, 1990

[86] PCT No.: PCT/EP90/00685

§ 371 Date: Jan. 29, 1991

§ 102(e) Date: Jan. 29, 1991

[87] PCT Pub. No.: WO90/13503

PCT Pub. Date: Nov. 19, 1990

[30] Foreign Application Priority Data

May 5, 1989 [DE] Fed. Rep. of Germany ..... 3914766
Mar. 15, 1990 [DE] Fed. Rep. of Germany ..... 4008220

[51] Int. Cl.[5] ..... B65H 20/02
[52] U.S. Cl. ..... 226/190; 492/36
[58] Field of Search ..... 226/174, 190, 194; 29/895.213, 895.22, 895.23, 893.3, 118, 119, 121.5, 126

[56] References Cited

U.S. PATENT DOCUMENTS

| | | | |
|---|---|---|---|
| 2,339,557 | 1/1944 | Runals | 226/190 X |
| 2,356,026 | 8/1944 | Berry | 27/121.5 X |
| 2,628,406 | 2/1953 | Allen | 29/121.5 X |
| 2,850,853 | 9/1958 | Simendinger | 29/121.5 X |
| 2,977,725 | 4/1961 | Simendinger | 29/121.5 X |
| 3,095,131 | 6/1963 | Robertson et al. | 226/194 X |
| 3,344,969 | 10/1967 | Collinge et al. | 226/190 X |
| 4,449,659 | 5/1984 | Tuchida | 226/190 |

FOREIGN PATENT DOCUMENTS

| | | |
|---|---|---|
| 2825320 | 12/1979 | Fed. Rep. of Germany . |
| 3518568 | 11/1986 | Fed. Rep. of Germany . |

*Primary Examiner*—Daniel P. Stodola
*Assistant Examiner*—Paul T. Bowen
*Attorney, Agent, or Firm*—Collard & Roe

[57] ABSTRACT

A profiled rod for a web-spreading roller has an elongated basic body of approximately C-shaped cross section with holding legs on both sides and with a friction-grip elastic support on its back. The support is fastened to an intermediate support made of stiffer material than the support itself and the intermediate support is pushed lengthwise onto the basic body and detachably fastened to its back and holding legs with a clamping claw.

8 Claims, 3 Drawing Sheets

PROFILED ROD FOR A WEB-SPREADING ROLLER

BACKGROUND OF THE INVENTION

1. Field of the Invention

The invention relates to a profiled rod for a web-spreading roller with an approximately C-shaped, extended basic element which can be displaced in the longitudinal direction of the spreading roller, with holder shanks on both sides to hold the profiled rod in place on support rings assigned to the roller axis, which has a longitudinal, frictionally-engaged, elastic contact surface on its back.

2. The Prior Art

A profiled rod of this type, known from DE-OS 24 00 741, consists of a blade element made of aluminum, which is provided with an elastomer surface layer. The production of the two parts of the profiled rod is complicated. Application of the surface layer requires extreme care and therefore takes a lot of time. Replacement of the surface layer is almost impossible to carry out, so that a worn profiled rod must be replaced with a new one. The surface layer tends to come loose, especially in the border areas, under the effect of the forces exerted by the web.

Furthermore, a profiled rod is known from practice which consists of a C-shaped metal rail with claw-shaped, bent-in holder shanks, and a contact surface glued onto the straight back. The contact surface is a plastic adhesive coating in the form of an adhesive strip which adheres on one side. The edges of the contact surface must end at a distance from the edges of the back, because the adhesive force is not sufficient there, and the contact surface can come loose. The useful surface to transfer force to the web is limited; the durability of the contact surface leaves something to be desired, since centrifugal force works on the contact surface. Applying or replacing the contact surface for repair purposes is difficult. Often, additional adhesive is used in order to increase the adhesive strength of the contact surface.

SUMMARY OF THE INVENTION

It is an object of the present invention to provide the type stated initially, which is durable in spite of the demanding working conditions in the spreading of webs, and distinguishes itself by cost-effective manufacture and easy installation and/or repair possibilities.

Profiled rod for a web-spreading roller with an approximately C-shaped, extended basic element which can be displaced in the longitudinal direction of the spreading roller, with holder shanks on both sides to hold the profiled rod in place on support rings assigned to the roller axis, which has a longitudinal, frictionally-engaged, elastic contact, characterized by the fact that the contact surface is attached to an intermediate carrier which is made from a more rigid material as compared with the contact surface and that the intermediate carrier is pushed onto the basic element in the longitudinal direction of the latter and held at its back and holder shanks with a clamp grip.

Since, in this embodiment, the contact surface is applied with the aid of the intermediate carrier, to the basic element responsible for holding, the intermediate carrier can be manufactured from a material which forms a very solid bond with the contact surface. The contact surface can therefore no longer separate from the intermediate carrier under the effect of the forces exerted by the web. The contact surface can furthermore extend over the entire removable width of the intermediate carrier. The intermediate carrier can be a pre-finished component with the contact surface, which can be manufactured in continuous lengths, in cost-efficient manner, and then cut to the length required in each case, and pushed onto the basic element as needed. The clamp grip of the intermediate carrier on the basic element is sufficient to reliably resist centrifugal force, on the one hand, and the forces of the web, on the other hand. The clamp grip holds the intermediate carrier with the contact surface securely on the basic element, even in the longitudinal direction, when it works on the web-spreading roller. The pre-tension is dimensioned in such a way that pulling on the intermediate carrier is easily possible, as is its rapid removal for repair purposes. Due to the simple, cost-effective production of the intermediate carrier with its contact surface, it can be thrown away when the contact surface is worn out, and replaced with a new segment. In this, it is advantageous that due to the clamp grip, it is not necessary to take material pairing between the intermediate carrier and the basic element into consideration, so that the material of the intermediate carrier can be freely selected in operation, with regard to cost-effective manufacture and a good bond with the contact surface, while the material of the basic element can be freely selected with regard to shape retention, lubricant properties and corrosion resistance.

The clamp grip of the intermediate carrier on the basic element, which is frictionally engaged and interdependent lock, ensures, that the intermediate carrier With the contact surface can no longer be detached from the basic element under the effects of centrifugal force and also the forces of the web, but on the other hand ensures that the intermediate carrier can be pulled off from the basic element for installation and repair by replacement. The non-positive lock of the clamp grip acts predominantly in the longitudinal direction of the basic element and prevents the intermediate carrier from being displaced on the basic element during spreading of the web, due to the reaction forces which occur in the longitudinal direction of the profiled rod. The clamp grip saves additional securing measures between the two parts.

In another embodiment, the profiled rod is characterized by the fact that the basic element is a profile made of a metal, the intermediate carrier is a profile made of a hard plastic, and the contact surface is a profile made of a soft plastic. The three materials in the combined composition, in particular, offer the best properties in use.

In a further embodiment continuous profiled billets, especially extruded profiles, can be manufactured inexpensively and with great dimensional accuracy, stored and shipped easily. No special tools are needed to cut them to the segments required in each case, and cutting can take place even directly at the place of use of the profiled rod. The shape accuracy of modern extrusion methods guarantees a correct fit of the components and the desired clamp fit, which can only be loosened by intentional removal, at all times.

In another embodiment, the profiled rod is characterized by the fact that the contact surface is produced in one piece with the intermediate carrier, preferably glued onto it. two components are even jointly produced in one extruded profile, which is practical due to the good bonding ability between hard PVC and soft PVC. It is also possible, however, to attach the contact surface to the intermediate carrier separately, by gluing. Here again it is advantageous that the intermediate carrier takes over the holding function for the contact surface, without being necessary for the shape stability and the lubricant properties of the profiled rod in operation. For this reason, the material selection for the intermediate carrier can be guided by a bond with the contact surface that is easy to produce, as strong as possible and durable.

In a further embodiment, the contact surface is reduced to one or more contact strips, which each grip the web and pull it into the desired position. At its free surface, the contact strip can be designed exclusively with regard to optimum grip relative to the web. Since the contact strip is attached at the intermediate carrier, which preferably consists of plastic, it is not subject to the restrictions which result from combining elastic plastic material with a relatively hard material, for example the metallic basic element. Even for critical web grades, optimum grip of the profiled rod relative to the web can be achieved, with optimum grip for especially sensitive webs being understood to mean particularly gentle but effective transfer of force. Because the top edge of the contact strip projects beyond the top of the intermediate carrier, the web does not even have to come into contact with the free surface of the intermediate carrier itself, so that the remnants of adhesive on the intermediate carrier, which were a problem until now, no longer have a disruptive influence. With the additional measure of the contact strip, the grip is optimized, on the one hand, while production of the profiled rod, i.e. of the intermediate carrier with the contact strip, is simplified. In the direction of rotation of the spreading roller, the positive lock between the contact strip and the intermediate carrier helps to transfer torque. But even in the longitudinal direction, there is a large transfer surface between the contact strip and the holder, so that even in the case of very strong grip, the contact strip does not migrate relative to the intermediate carrier. The contact strip can be attached in the longitudinal groove, using an adhesive that remains elastic after curing, which precludes hard adhesive contamination at the free surfaces. The groove prevents any adhesive from coming out at all. Furthermore, the groove edge gives the inserted contact strip a good support.

In a further embodiment, the contact strip is formed of one piece with the intermediate carrier and holds the web lifted up at such a distance from the free top surface of the intermediate carrier that the web no longer comes into contact with the other components. For this, it is advantageous to give the projecting contact strip a surface texture. This could be done with a following knurled wheel in production.

In another embodiments the free surface of the contact strip additionally increases the grip between the profiled rod and the web. Two different aspects can be implemented with this. In the case of rough webs which can withstand stress, a positive lock can be achieved in addition to the simple friction lock. In the case of particularly sensitive web grades, on the other hand, especially gentle transfer of force, which nevertheless ensures a friction lock, can be predetermined.

In a further embodiment, a cross-sectional shape can be implemented with simple shapes. A good hold of the profiled rod in the spreading roller, with constantly low displacement resistance, is achieved with the converging holder shanks. The clamp grip of the shanks offers a self-locking, secure fit, with sufficient tolerance, to which the arches, which remain free, also contribute. The shanks approximately adapt to the angle of the side wall of the stay.

In another embodiments, the stays have an approximately prism-shaped cross-section, which is very easy to manage in terms of production technology. The back, with its convex curvature, ensures the desired line-shaped contact surface area in cooperation with the straight bottom side of the profiled rod. During slight tipping movements, which the profiled rod can certainly exert on the stay, the contact surface area moves in the circumference direction on the back of the stay. This does not play any role for effective transfer of the spreading forces to the web; with regard to the easy mobility of axial displacement, which must be guaranteed at all times, this is a desired effect. The converging holder shanks rest against the converging flanks under the effect of centrifugal force, if the profiled rod is not already pressed against the back of the stay in the line-shaped contact surface anyway, due to the contact pressure of the web. The cross-sectional shape selected is also advantageous from the point of view of production technology, installation and removal of the profiled rods is especially easy, because these only need to be pushed on or pulled off in the axial direction.

In a further embodiment, the profiled rod is characterized by the fact that the intermediate carrier possesses a straight stay in cross-section, and converging, projecting, straight clamp shanks, each via an arch, which form an angle $\beta$ with the cross-stay that is smaller than the angle $\alpha$. When pushing the intermediate carrier on, the strength of the convergence of its clamp shanks is adapted to the convergence of the holder shanks of the basic element by elastic deformation, and the desired adaptation is achieved at the same time.

An exemplary embodiment of the invention will be explained on the basis of the drawing.

DETAILED DESCRIPTION OF THE PREFERRED EMBODIMENTS

Figure 6:
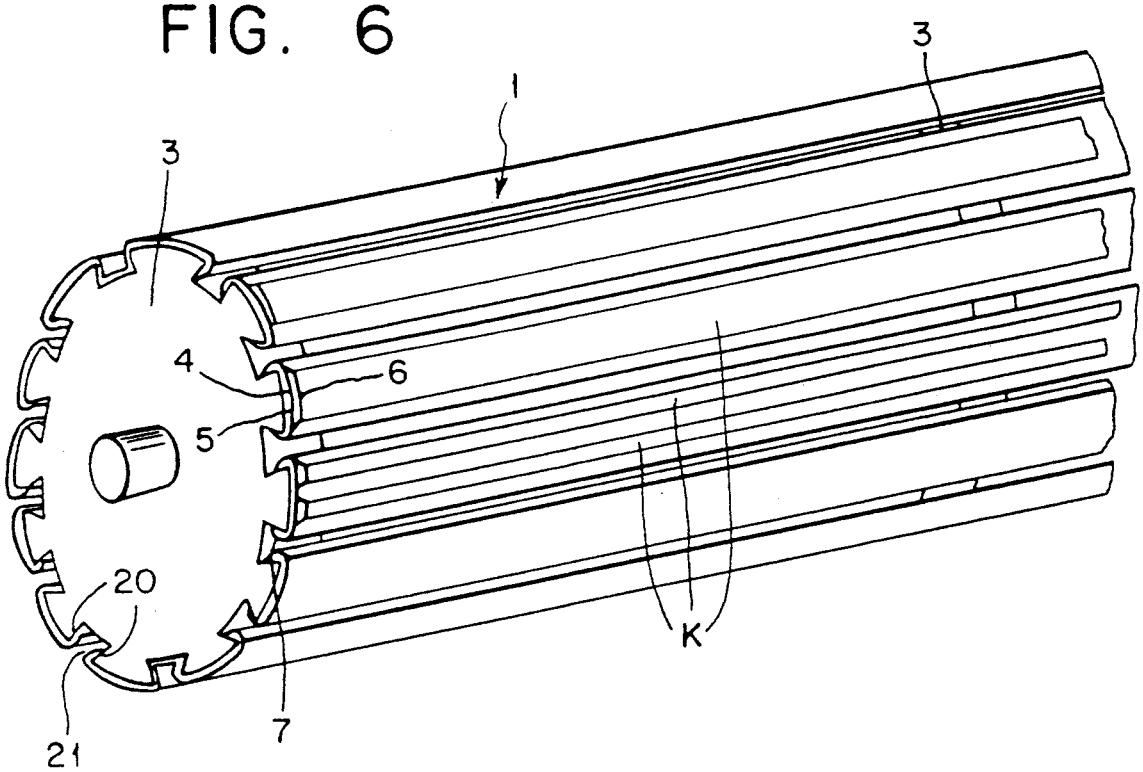
FIG. 6 shows a perspective view of a web-spreading roller.

A profiled rod 1 sits on a stay 2, which is approximately trapezoid in cross-section and undercut, of a support ring 3 of a web spreading roller shown in FIG. 6. The profiled rod 1 has the shape indicated in FIG. 2 in a top view. The mantle of the spreading roller is formed of a multiplicity of profiled rods 1 closely adjacent to one another, which overlap in the center area of the spreading roller with finger-like end parts 27, and which are alternately pulled apart and pushed together again in the axial direction during each turn of the spreading roller. The web 29 on the spreading roller is spread out by this. This is a common principle. Usually, several support rings 3 with aligning stays 2 are placed one behind the other in the spreading roller, in order to guide the profiled rods 1.

The profiled rod 1 consists of a basic element 4, approximately C-shaped in cross-section, furthermore of an intermediate carrier 5 pushed onto the basic element 4 in the longitudinal direction, with approximately the same cross-section, only slightly broader, as the basic element 4, and a contact surface 6 applied to the outside 13 of the intermediate carrier 4, which is friction-active and elastic.

The basic element 4 consists, e.g., of stainless steel, and is a cut segment of a continuous profiled billet, most practically an extruded profile. In cross-section, it has an even, straight back part 9, from which converging, straight holder shanks 7 jut out via arches 8 on both sides. The angle enclosed between each holder shank 7 and the back part 9 lies at approximately 57° in the embodiment shown.

The intermediate carrier 5 consists, e.g., of a segment of a continuous extruded profile made of hard PVC. In cross-section, it has a straight cross-stay 12, from which converging clamp shanks 10 jut out via arches 11. The clamp shanks 10 are pressed against the holder shanks 7 from the outside with pretension. The dotted line 25 indicates that the clamp shank 10 encloses an angle $\beta$ with the cross-stay 12 when the intermediate carrier 5 is pulled off, which is smaller than the angle $\alpha$. The greatest width of the intermediate carrier 5 is indicated as B. The contact surface 6 has a convex curved top surface 14, with an arch, where it is practical for the radius of curvature to have the axis of the spreading roller, (see FIG. 6), as its center point. At both edges, the contact surface 6 ends just before the greatest width B of the intermediate carrier 5 with edge lips 15 that narrow in wedge shape. The edge lips 15 are flattened on the outside in the area 16. A sickle-shaped clear space 17 remains between each arch 11 of the intermediate carrier 5 and the adjacent arch 8 of the basic element 4, which space ensures a secure clamp fit of the intermediate carrier 5 on the basic element 4. The intermediate carrier 5 therefore has only linear contact with the holding stay 2.

The contact surface 6 can be produced in one piece with the intermediate carrier 5, e.g. extruded. It is practical if the contact surface 6 consists of soft PVC with a Shore hardness of approximately 60°. It is also possible, however, to glue the contact surface 6 onto the intermediate carrier 5. Since hard PVC and soft PVC can be tightly bonded together, this yields great resistance of the contact surface 6 against removal. The bonding zone between the contact surface 6 and the intermediate carrier 5 is indicated with 24.

Figure 2:
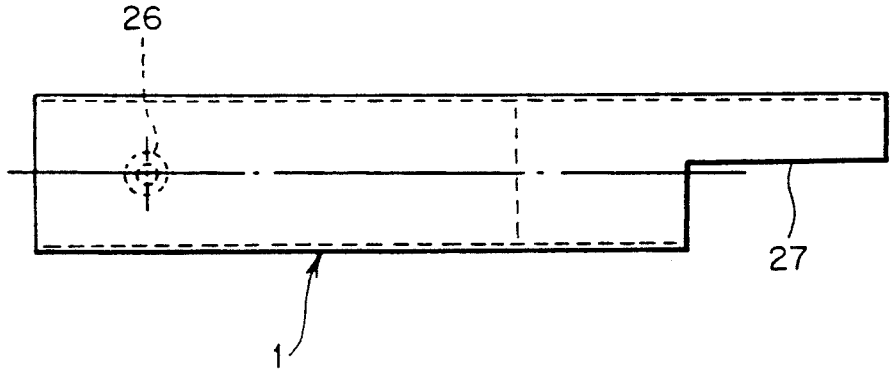

The stay 2 of the support ring 3 has a convex curved back 18, with an arc around the axis of the spreading roller, (see FIG. 6), on which the basic element 4 rests with linear contact 19, so that clear spaces 23 occur between the shoulders 22 in the cross-section of the stay 2 and the basic element 4. Between the insides of the holder shanks 7 and the side walls 20 of the stay 2, narrow slots are kept clear in this position. A recess 21 connects with the side walls 20, and leads to the adjacent side wall 20, (see FIG. 6) of the next stay 2. With this structure, the profiled rods 1 can be placed very close to one another, so that in operation, they might even touch one another with their arches 11. In FIG. 2, it is indicated with 26 how every profiled rod 1 is coupled with an axial displacement drive.

The intermediate carrier 5 connected with the contact surface 6 is pushed onto the basic element 4 in the longitudinal direction of the latter, so that it is secured on the holder shanks 7 and the back 28 of the basic element 4 with a clamp grip. This clamp grip prevents the intermediate carrier 5 from lifting too far off the basic element 4 under the effect of centrifugal force. Furthermore, the clamp grip achieves a hold of the intermediate carrier 5 in the longitudinal direction of the profiled rod 1, which ensures perfect transfer of the spreading forces to the web 29. However, the clamp grip makes it possible to push the intermediate carrier 5 with the contact surface 6 on with a reasonable amount of force, and to remove it again for replacement. It is practical if the intermediate carrier 5 with the contact surface 6 is cut to the required length from a continuous extruded profile.

Even if the profiled rod 1 tips on the stay 2 under the pressure of the web, three-point contact is essentially maintained, allowing easy displacement of the profiled rod 1.

Figure 3:
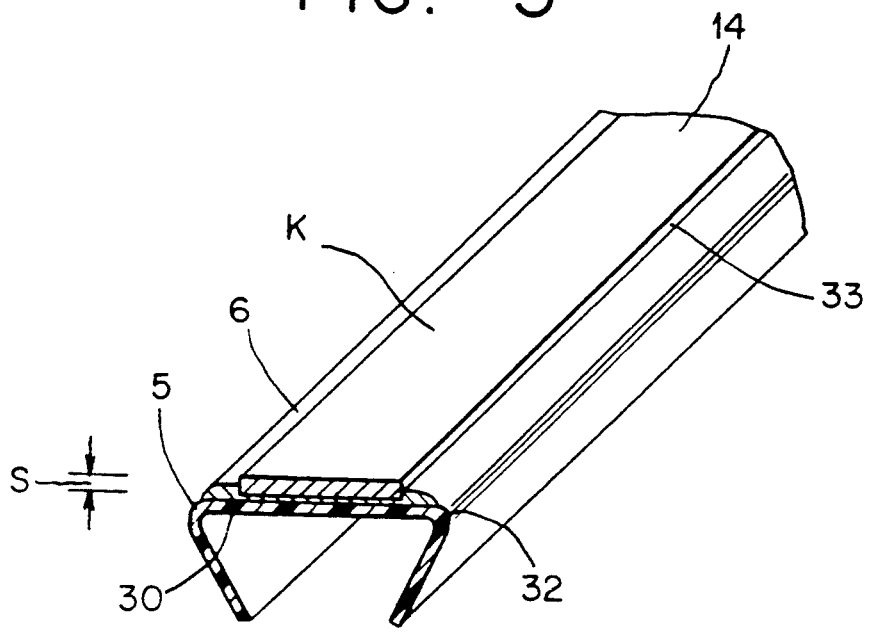

FIG. 3 shows a profiled rod 1 without a basic element 4. On the back, i.e. the cross-stay 12 of the intermediate carrier 5, a contact surface of elastic plastic material with an embossed surface is applied by gluing; this surface extends to the side shoulders 32 of the intermediate carrier 5. In this embodiment, a single wide longitudinal groove 30 is molded into the plastic contact surface 6, with a contact strip K glued into it. The thickness s of contact strip K is selected in such a way that the longitudinal edges of the contact strip K, designated as 33, project slightly beyond the contact surface 6.

Figure 1:
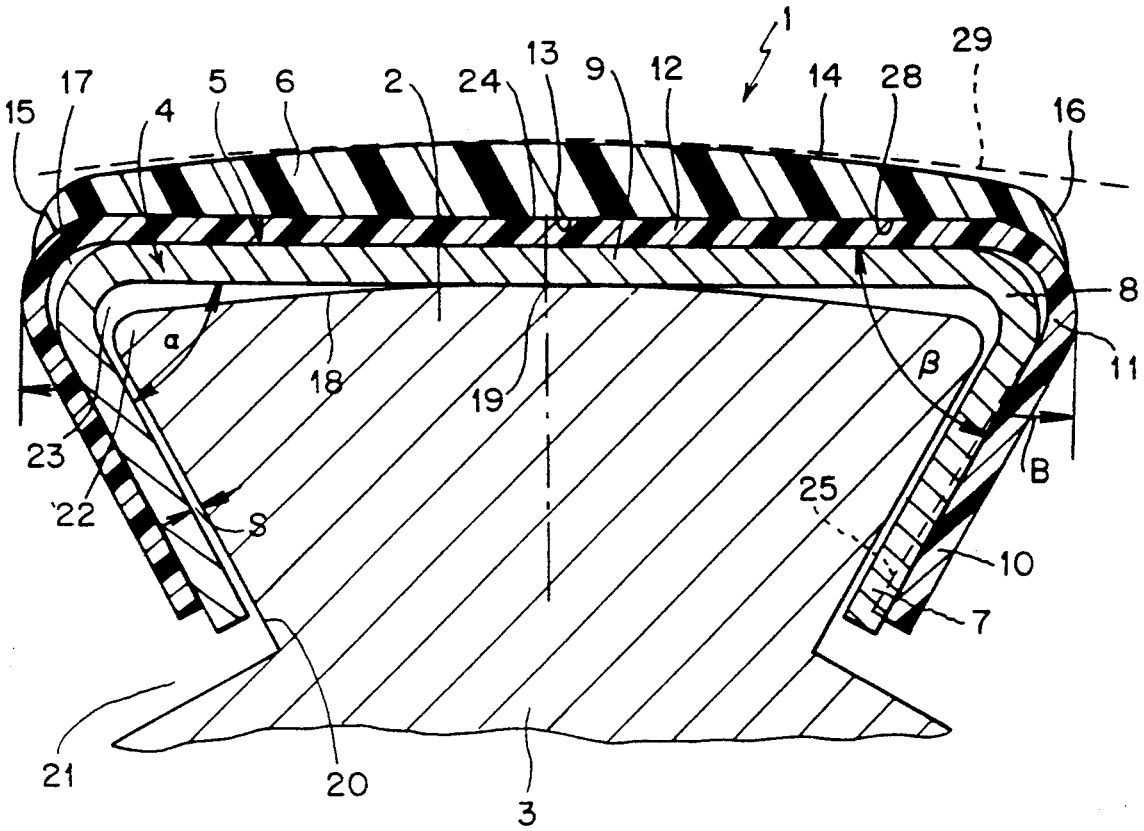
FIG. 1 a cross-section through a profiled rod of a web-spreading roller in readiness for operation, FIG. 2 a top view of a profiled rod in the removed state, FIG. 3 a perspective view of an embodiment of a profiled rod without the basic element, FIG. 4 a perspective view of another embodiment of a profiled rod and FIG. 5 another variant of a profiled rod without the basic element, in a perspective view.
Figure 4:
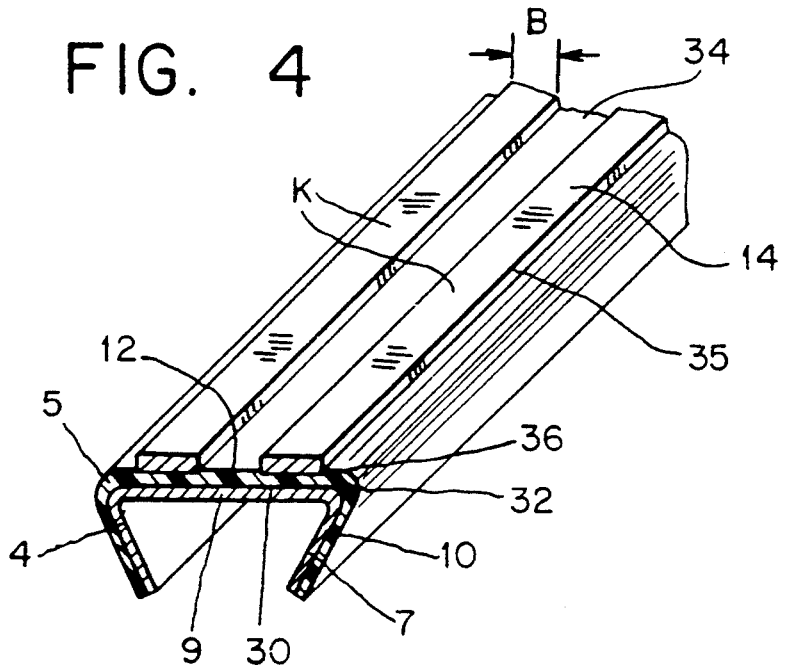

As FIG. 4 shows, the longitudinal grooves 30 are already molded into the intermediate carrier 5, and arranged in such a way that the distance between the grooves 30 approximately corresponds to the groove width B. A contact strip K, made of soft elastic material, is inserted in each longitudinal groove 30, and attached with adhesive. In this embodiment, the elastic contact surface 6 pursuant to FIG. 1 is eliminated and replaced with the inserted contact strips K. The side edges 35 of the contact strips K rest against the groove edges 36. The adhesive therefore only has to be provided in the center, under the contact strip K, so that it does not come out at the side edges. The free top surfaces 14 of the contact strips K project out of the surface of the intermediate carrier 5 and they are designed with a view to optimum grip for the web 29, e.g. structured to be profiled or sticky, or provided with a textile texturing. It is practical to make the contact strips K consist of a carrier material with a surface mohair layer. The intermediate element 5 rests on the basic element 4 with its clamp shanks 10 and thereby surrounds the back part 9 and its holder shanks 7.

Figure 5:
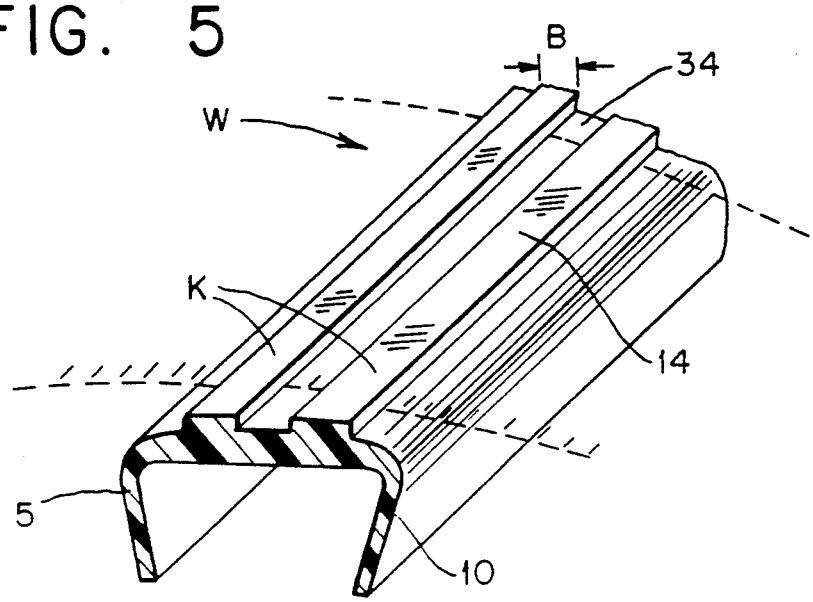

In the embodiment pursuant to FIG. 5, the contact strips K are formed in one piece with the intermediate carrier 5, for example by extrusion. Again, the free top surface of the contact strips can be profiled or sticky or provided with a textile structure. Between the two contact strips K there is an intermediate space 34, the width of which approximately corresponds to the contact strip width B. The free top surfaces 14 of the two contact strips K are either flat, with a roof-like angle relative to one another, or slightly embossed. The web W is slightly pulled into the intermediate space 34 and also at both sides of the contact strips as it passes over the profiled rod, which increases the grip of the free top surfaces 14.

What is claimed is:

1. Profiled rod for use with a web-spreading roller comprising:

an approximately C-shaped, extended basic element which can be displaced in a longitudinal direction of the web-spreading roller;

said basic element having a holder shank on each side to hold the profiled rod in place on support rings attached to the web-spreading roller;

said basic element having a longitudinal, frictionally-engaged, intermediate carrier on the back of said basic element;

an elastic contact surface attached to said intermediate carrier which is made from a more rigid material as compared with the contact surface;

said intermediate carrier being pushed onto said basic element in a longitudinal direction of the basic element and held at the back of the basic element and holder shanks with a clamp grip of the intermediate carrier.

2. Profiled rod according to claim 1, wherein the basic element is a profile made of a metal;

wherein the intermediate carrier is a profile made of a plastic; and wherein the contact surface is a profile made of a plastic.

3. Profiled rod according to claim 1, wherein the contact surface is inserted, as a contact strip, in a positive lock and held in place in at least one longitudinal groove provided in the intermediate carrier and projects out with its top surface.

4. Profiled rod according to claim 1, wherein the contact surface is formed of at least one contact strip, which runs along the length of the profiled rod and is connected with the intermediate carrier.

5. Profiled rod according to claim 4, wherein a free top surface of the contact strip has a texturing.

6. Profiled rod according to claim 1, wherein the basic element possesses a straight back part in cross section, and converging, straight holder shanks projecting from the back part creating an arch, each of which encloses an angle ($\alpha$) of approximately 60° with the back part.

7. Profiled rod according to claim 1, wherein the basic element rests against the stay of the support ring, which has a convex curvature in the radial direction, in linear form with its back part and that the holder shanks come to rest against the side wall of the stay with linear contact.

8. Profiled rod according to claim 1, wherein the intermediate carrier possesses a straight stay in cross section, and converging, projecting, straight clamp shanks, creating an arch which forms an angle (62°) with the straight stay that is smaller than the angle (60°).

* * * * *